US009149071B2

(12) United States Patent
Kizer et al.

(10) Patent No.: US 9,149,071 B2
(45) Date of Patent: Oct. 6, 2015

(54) SMOKE FILTERS FOR REDUCING COMPONENTS IN A SMOKE STREAM

(71) Applicant: Celanese Acetate LLC, Irving, TX (US)

(72) Inventors: Lawton E. Kizer, Blacksburg, VA (US); Raymond M. Robertson, Blacksburg, VA (US)

(73) Assignee: Celanese Acetate LLC, Irving, TX (US)

( * ) Notice: Subject to any disclaimer, the term of this patent is extended or adjusted under 35 U.S.C. 154(b) by 0 days.

(21) Appl. No.: 14/202,609

(22) Filed: Mar. 10, 2014

(65) Prior Publication Data

US 2014/0261502 A1 Sep. 18, 2014

Related U.S. Application Data

(60) Provisional application No. 61/779,114, filed on Mar. 13, 2013.

(51) Int. Cl.
*A24D 3/08* (2006.01)
*A24D 3/10* (2006.01)
*A24D 3/16* (2006.01)

(52) U.S. Cl.
CPC .. *A24D 3/16* (2013.01); *A24D 3/08* (2013.01); *A24D 3/10* (2013.01)

(58) Field of Classification Search
USPC ..... 131/331, 332, 341, 342, 344; 493/39–50
See application file for complete search history.

(56) References Cited

U.S. PATENT DOCUMENTS

| | | | | |
|---|---|---|---|---|
| 2,957,285 | A | 10/1960 | Molins | |
| 3,205,107 | A | 9/1965 | Gallagher | |
| 3,400,032 | A | 9/1968 | Sexstone et al. | |
| 3,403,202 | A | 9/1968 | Green | |
| 3,405,717 | A * | 10/1968 | Berger et al. | 131/94 |
| 3,483,331 | A | 12/1969 | Hasser | |
| 4,257,754 | A | 3/1981 | Green et al. | |
| 4,379,465 | A | 4/1983 | Coq | |
| 4,516,589 | A | 5/1985 | Rainer et al. | |
| 6,080,457 | A | 6/2000 | Charlton et al. | |
| 6,989,101 | B2 | 1/2006 | Cumberland et al. | |
| 7,141,636 | B1 | 11/2006 | Ehlers et al. | |
| 9,027,566 | B2 | 5/2015 | Garrett et al. | |
| 2002/0166564 | A1 | 11/2002 | Sung | |
| 2002/0195115 | A1 | 12/2002 | Meier | |
| 2004/0250827 | A1 | 12/2004 | Deevi et al. | |
| 2005/0004299 | A1 | 1/2005 | Haftka et al. | |
| 2006/0174902 | A1 | 8/2006 | Zhou et al. | |
| 2008/0090081 | A1 | 4/2008 | Matsumoto et al. | |
| 2008/0173320 | A1 | 7/2008 | Dunlap et al. | |
| 2010/0125039 | A1 | 5/2010 | Banerjee et al. | |
| 2011/0162667 | A1 * | 7/2011 | Burke et al. | 131/332 |
| 2013/0032158 | A1 * | 2/2013 | Garrett et al. | 131/280 |

FOREIGN PATENT DOCUMENTS

| | | | |
|---|---|---|---|
| CN | 101642287 | A | 2/2010 |
| GB | 1059421 | A | 2/1967 |
| GB | 1104993 | A | 3/1968 |
| GB | 2010067 | A | 6/1979 |
| GB | 2030440 | A | 4/1980 |
| GB | 1592952 | A | 7/1981 |
| JP | 199017989 | | 1/1990 |
| JP | 2000342916 | A | 12/2000 |
| JP | 2001187305 | A | 7/2001 |
| JP | 2002512012 | A | 4/2002 |
| JP | 2002355512 | A | 12/2002 |
| JP | 3483331 | B2 | 1/2004 |
| JP | 2007527698 | A | 10/2007 |
| JP | 2010035550 | A | 2/2010 |
| WO | 9953778 | A2 | 10/1999 |
| WO | 00/18810 | A2 | 4/2000 |
| WO | 03039277 | A1 | 5/2003 |
| WO | 2004110186 | A1 | 12/2004 |
| WO | 2009112591 | A2 | 9/2009 |
| WO | 2011121358 | A1 | 10/2011 |
| WO | 2012047346 | A1 | 4/2012 |
| WO | 2012047347 | A1 | 4/2012 |
| WO | 2012047348 | A1 | 4/2012 |
| WO | 2012047349 | A1 | 4/2012 |
| WO | 2012051548 | A2 | 4/2012 |
| WO | 2014164492 | A1 | 10/2014 |

OTHER PUBLICATIONS

Official Action for JP Patent Application No. 2013-542267 dated Jul. 8, 2014.

(Continued)

*Primary Examiner* — Dennis Cordray
(74) *Attorney, Agent, or Firm* — McDermott Will & Emery LLP; Kurt Jones

(57) ABSTRACT

Smoke filters that reduce the concentration of carbon monoxide and phenols in a smoke stream may include a porous mass section comprising a plurality of active particles, a plurality of binder particles, and an active coating disposed on at least a portion of the active particles and the binder particles, wherein the active particles and the binder particles are bound together at a plurality of contact points; and a filter section. In some instances, a filter may include a porous mass section comprising a plurality of active particles and a plurality of binder particles, wherein the active particles and the binder particles are bound together at a plurality of contact points without an adhesive; and a filter section comprising an active dopant.

11 Claims, No Drawings

(56) References Cited

OTHER PUBLICATIONS

Official Action for Chinese Application No. 201310273059.3 dated Dec. 10, 2014.
Official Action for JP Patent Application No. 2013-532798 dated Jan. 20, 2015.
Official Action for Japanese Patent Application No. 2013-534041 dated Sep. 24, 2014.
Official Action for Canadian Patent Application 2,812,104 dated Aug. 13, 2014.
UHMW (Ultra High Molecular Weight Polyethylene), Product Information Sheet, Poly-Tech Industrial, Inc. 2011, [online], Retrieved from the Internet, [retrieved on Jul. 2, 2014], URL: http://www.polytechindustrial.com/products/plastic-stock-shapes/uhmw-polyethylene.
Official Action for Chinese Application No. 201280003756.0 dated Sep. 19, 2014.
Official Action for Canadian Patent Application 2,814,074 dated Sep. 25, 2014.
International Search Report and Written Opinion for PCT/US2014/022585 dated Jul. 17, 2014.
BAT Bondex Sbtb55a99—Bondex Filter Rods Using Polythene Plus Trisodium Orthophosphate 12H20 as a Bonding Agent, Confidential File Note No. 0709, 1966.
Summary of American Filtrona and B & W Bonded Charcoal Filter Patents Covering Products, Apparatus and Methods, not dated.
Announcing New Tempo Filter Cigarettes . . . First With the New Bonded Charcoal Filter, Ad No. 138-101A, 1964.
Memo dated Jun. 28, 1965 from J.E. Wickham to Mr. F.E. Resnik re: Polyethylene in Tempo and Sano Filters.
Table I, New or Modified Cigarettes in 1964.
Memo from V.C. Johnson to Mr. F.E. Resnik dated Mar. 29, 1965 re: Sano and Tempo Bonded Carbon Filters.
C.I. Report No. 2-65 dated Feb. 28, 1965.
Memo from V.C. Johnson to Mr. J.S. Osmalov (6) dated Nov. 24, 1964 re.: P.M. Bonded Carbon Cigarette Filters vs. Tempo Bonded Carbon Filter Rods.
Reynolds, R.J., Theory of Cigarette Smoke Filtration, report. Legacy Tobacco Documents Library, University of CA, San Francisco, 1995, [online], retrieved from the internet, http://legacy.library.ucsf.edu/tid/pmc01d00/pdf, retrieved Jan. 30, 2015.
Official Action for European Patent Application No. 12846228.0 dated May 19, 2015.

* cited by examiner

SMOKE FILTERS FOR REDUCING COMPONENTS IN A SMOKE STREAM

BACKGROUND

The present invention relates to smoke filters that reduce the concentration of components in a smoke stream, including methods and smoking devices related thereto.

Increasingly, governmental regulations require higher filtration efficacies in removing harmful components from tobacco smoke, e.g., carbon monoxide and phenols. With present cellulose acetate, higher filtration efficacies can be achieved by doping the filter with increasing concentrations of particles like activated carbon. However, increasing particulate concentration changes draw characteristics for smokers.

One measure of draw characteristics is the encapsulated pressure drop. As used herein, the term "encapsulated pressure drop" or "EPD" refers to the static pressure difference between the two ends of a specimen when it is traversed by an air flow under steady conditions when the volumetric flow is 17.5 ml/sec at the output end and when the specimen is completely encapsulated in a measuring device so that no air can pass through the wrapping. EPD has been measured herein under the CORESTA ("Cooperation Centre for Scientific Research Relative to Tobacco") Recommended Method No. 41, dated June 2007. Higher EPD values translate to the smoker having to draw on a smoking device with greater force.

Because increasing filter efficacy changes the EPD of the filters, the public, and consequently manufactures, have been slow to adopt most technologies. Therefore, despite continued research, there remains an interest in developing improved and more effective compositions that minimally effect draw characteristics while removing higher levels of certain constituents in mainstream tobacco smoke like carbon monoxide and phenols.

DETAILED DESCRIPTION

The present invention relates to smoke filters that reduce the concentration of components in a smoke stream, including methods and smoking devices related thereto.

Smoke filters described herein may include sections designed to reduce the concentration of carbon monoxide and/or phenols in the smoke stream while allowing for tailorable draw characteristics that can be designed to a manufacturer's specifications. The smoke filters described herein include at least one porous mass section and at least one filter section.

The term "porous mass" as used herein refers to a mass comprising a plurality of binder particles and a plurality of active particles mechanically bound at a plurality of contact points. Said contact points may be active particle-binder contact points, binder-binder contact points, and/or active particle-active particle contact points. As used herein, the terms "mechanical bond," "mechanically bonded," "physical bond," and the like refer to a physical connection that holds two particles together. Mechanical bonds may be rigid or flexible depending on the bonding material. Mechanical bonding may or may not involve chemical bonding. Generally, the mechanical binding does not involve an adhesive, though, in some embodiments, an adhesive may be used after mechanical binding to adhere other additives to portions of the organic porous mass.

As used herein, the terms "particle" and "particulate" may be used interchangeably and include all known shapes of materials, including spherical and/or ovular, substantially spherical and/or ovular, discus and/or platelet, flake, ligamental, acicular, fibrous, polygonal (such as cubic), randomly shaped (such as the shape of crushed rocks), faceted (such as the shape of crystals), or any hybrid thereof. Nonlimiting examples of porous masses are described in detail in copending applications PCT/US2011/043264, PCT/US2011/043268, PCT/US2011/043269, and PCT/US2011/043271, the entire disclosures of which are included herein by reference.

It should be noted that when "about" is provided below in reference to a number, the term "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

In some embodiments, the porous mass sections described herein may comprise active particles and binder particles.

One example of an active particle is activated carbon (or activated charcoal or active coal). The activated carbon may be low activity (about 50% to about 75% $CCl_4$ adsorption) or high activity (about 75% to about 95% $CCl_4$ adsorption) or a combination of both. In some embodiments, the active carbon may be nano-scaled carbon particle, such as carbon nanotubes of any number of walls, carbon nanohorns, bamboo-like carbon nanostructures, fullerenes and fullerene aggregates, and graphene including few layer graphene and oxidized graphene. Other examples of active particles may include, but are not limited to, ion exchange resins, desiccants, silicates, molecular sieves, silica gels, activated alumina, zeolites, perlite, sepiolite, Fuller's Earth, magnesium silicate, metal oxides (e.g., iron oxide, iron oxide nanoparticles like about 12 nm $Fe_3O_4$, manganese oxide, copper oxide, and aluminum oxide), gold, platinum, cellulose acetate, iodine pentoxide, phosphorus pentoxide, nanoparticles (e.g., metal nanoparticles like gold and silver; metal oxide nanoparticles like alumina; magnetic, paramagnetic, and superparamagnetic nanoparticles like gadolinium oxide, various crystal structures of iron oxide like hematite and magnetite, gado-nanotubes, and endofullerenes like $Gd@C_{60}$; and core-shell and onionated nanoparticles like gold and silver nanoshells, onionated iron oxide, and others nanoparticles or microparticles with an outer shell of any of said materials) and any combination of the foregoing (including activated carbon). Ion exchange resins include, for example, a polymer with a backbone, such as styrene-divinyl benzene (DVB) copolymer, acrylates, methacrylates, phenol formaldehyde condensates, and epichlorohydrin amine condensates; and a plurality of electrically charged functional groups attached to the polymer backbone. In some embodiments, the active particles are a combination of various active particles. In some embodiments, the porous mass may comprise multiple active particles. In some embodiments, an active particle may comprise at least one element selected from the group of active particles disclosed herein. It should be noted that "element" is being used as a general term to describe items in a list. In some embodiments, the active particles are combined with at least one flavorant.

In some embodiments, the active particles may be chosen to reduce the concentration of carbon monoxide. Reduction of carbon monoxide by current cigarette filter designs primarily rely on tobacco blend, tobacco burn rate, and paper porosity that enhances ventilation to dilute the carbon monoxide. Commercially, there is a lack of active avenues for reducing carbon monoxide in a smoke stream. Examples of suitable active particles for reducing carbon monoxide may include, but are not limited to, iodine pentoxide, phosphorous pentoxide, manganese oxide, copper oxide, iron oxide, molecular sieves, aluminum oxide, gold, platinum, and the like, and any combination thereof.

In some embodiments, the active particles may have an average diameter in least one dimension ranging from a lower limit of about less than one nanometer (e.g., graphene), about 0.1 nm, 0.5 nm, 1 nm, 10 nm, 100 nm, 500 nm, 1 micron, 5 microns, 10 microns, 50 microns, 100 microns, 150 microns, 200 microns, and 250 microns to an upper limit of about 5000 microns, 2000 microns, 1000 microns, 900 microns, 700 microns, 500 microns, 400 microns, 300 microns, 250 microns, 200 microns, 150 microns, 100 microns, 50 microns, 10 microns, and 500 nm, wherein the average diameter may range from any lower limit to an upper limit and encompass any subset therebetween. In some embodiments, the active particles may be a mixture of particle sizes.

Examples of binder particles may include, but are not limited to, polyolefins, polyesters, polyamides (or nylons), polyacrylics, polystyrenes, polyvinyls, polytetrafluoroethylene (PTFE), polyether ether ketone (PEEK), any copolymer thereof, any derivative thereof, and any combination thereof. Examples of suitable polyolefins include, but are not limited to, polyethylene, polypropylene, polybutylene, polymethylpentene, any copolymer thereof, any derivative thereof, any combination thereof and the like. Examples of suitable polyethylenes further include low-density polyethylene, linear low-density polyethylene, high-density polyethylene, any copolymer thereof, any derivative thereof, any combination thereof and the like. Examples of suitable polyesters include polyethylene terephthalate, polybutylene terephthalate, polycyclohexylene dimethylene terephthalate, polytrimethylene terephthalate, any copolymer thereof, any derivative thereof, any combination thereof and the like. Examples of suitable polyacrylics include, but are not limited to, polymethyl methacrylate, any copolymer thereof, any derivative thereof, any combination thereof and the like. Examples of suitable polystyrenes include, but are not limited to, polystyrene, acrylonitrile-butadiene-styrene, styrene-acrylonitrile, styrene-butadiene, styrene-maleic anhydride, any copolymer thereof, any derivative thereof, any combination thereof and the like. Examples of suitable polyvinyls include, but are not limited to, ethylene vinyl acetate, ethylene vinyl alcohol, polyvinyl chloride, any copolymer thereof, any derivative thereof, any combination thereof and the like. Examples of suitable cellulosics include, but are not limited to, cellulose acetate, cellulose acetate butyrate, plasticized cellulosics, cellulose propionate, ethyl cellulose, any copolymer thereof, any derivative thereof, any combination thereof and the like. In some embodiments, a binder particle may be any copolymer, any derivative, and any combination of the above listed binders.

In some embodiments, the binder particles described herein may have a hydrophilic surface treatment. Hydrophilic surface treatments (e.g., oxygenated functionalities like carboxy, hydroxyl, and epoxy) may be achieved by exposure to at least one of chemical oxidizers, flames, ions, plasma, corona discharge, ultraviolet radiation, ozone, and combinations thereof (e.g., ozone and ultraviolet treatments). Because many of the active particles described herein are hydrophilic, either as a function of their composition or adsorbed water, a hydrophilic surface treatment to the binder particles may increase the attraction (e.g., van der Waals, electrostatic, hydrogen bonding, and the like) between the binder particles and the active particles. This enhanced attraction may mitigate segregation of active and binder particles in the matrix material, thereby minimizing variability in the EPD, integrity, circumference, cross-sectional shape, and other properties of the resultant porous masses. Further, it has been observed that the enhanced attraction provides for a more homogeneous matrix material, which can increase flexibility for filter design (e.g., lowering overall EPD, reducing the concentration of the binder particles, or both).

The binder particles may assume any shape. Such shapes include spherical, hyperion, asteroidal, chrondular or interplanetary dust-like, granulated, potato, irregular, and any combination thereof. In preferred embodiments, the binder particles suitable for use in the present invention are non-fibrous. In some embodiments, the binder particles are in the form of a powder, pellet, or particulate.

In some embodiments, the binder particles may have an average diameter in least one dimension ranging from a lower limit of about 0.1 nm, 0.5 nm, 1 nm, 10 nm, 100 nm, 500 nm, 1 micron, 5 microns, 10 microns, 50 microns, 100 microns, 150 microns, 200 microns, or 250 microns to an upper limit of about 5000 microns, 2000 microns, 1000 microns, 900 microns, 700 microns, 500 microns, 400 microns, 300 microns, 250 microns, 200 microns, 150 microns, 100 microns, 50 microns, 10 microns, or 500 nm, wherein the average diameter may range from any lower limit to an upper limit and encompass any subset therebetween. In some embodiments, the binder particles may be a mixture of particle sizes.

In some embodiments, the binder particles may have a bulk density ranging about 0.10 g/cm$^3$ to about 0.55 g/cm$^3$, including any subset therebetween (e.g., about 0.17 g/cm$^3$ to about 0.50 g/cm$^3$ or about 0.20 g/cm$^3$ to about 0.47 g/cm$^3$).

In some embodiments, the binder particles may exhibit virtually no flow at its melting temperature, i.e., when heated to its melting temperature exhibits little to no polymer flow. Materials meeting these criteria may include, but are not limited to, ultrahigh molecular weight polyethylene ("UHMWPE"), very high molecular weight polyethylene ("VHMWPE"), high molecular weight polyethylene ("HMWPE"), and any combination thereof. As used herein, the term "UHMWPE" refers to polyethylene compositions with weight-average molecular weight of at least about $3\times10^6$ g/mol (e.g., about $3\times10^6$ g/mol to about $30\times10^6$ g/mol, including any subset therebetween). As used herein, the term "VHMWPE" refers to polyethylene compositions with a weight average molecular weight of less than about $3\times10^6$ g/mol and more than about $1\times10^6$ g/mol, including any subset therebetween. As used herein, the term "HMWPE" refers to polyethylene compositions with weight-average molecular weight of at least about $3\times10^5$ g/mol to $1\times10^6$ g/mol. For purposes of the present specification, the molecular weights referenced herein are determined in accordance with the Margolies equation ("Margolies molecular weight").

In some embodiments, the binder particles may have a melt flow index ("MFI"), a measure of polymer flow, as measured by ASTM D1238 at 190° C. and 15 kg load ranging form a lower limit of about 0, 0.5, 1.0, or 2.0 g/10 min to an upper limit of about 3.5, 3.0, 2.5, 2.0, 1.5, or 1.0, wherein the MFI may range from any lower limit to an upper limit and encompass any subset therebetween. In some embodiments, the porous mass sections may comprise a mixture of binder particles having different molecular weights and/or different melt flow indexes.

In some embodiments, the binder particles may have an intrinsic viscosity ranging from about 5 dl/g to about 30 dl/g (including any subset therebetween) and a degree of crystallinity of about 80% or more (e.g., about 80% to about 100%, including any subset therebetween) as described in U.S. Patent Application Publication No. 2008/0090081.

Examples of commercially available polyethylene materials suitable for use as binder particles described herein may include GUR® (UHMWPE, available from Ticona Polymers LLC, DSM, Braskem, Beijing Factory No. 2, Shanghai Chemical, Qilu, Mitsui, and Asahi) including GUR® 2000 series (2105, 2122, 2122-5, 2126), GUR® 4000 series (4120, 4130, 4150, 4170, 4012, 4122-5, 4022-6, 4050-3/4150-3), GUR® 8000 series (8110, 8020), and GUR® X series (X143, X184, X168, X172, X192). Another example of a suitable polyethylene material is that having a molecular weight in the range of about 300,000 g/mol to about 2,000,000 g/mol as determined by ASTM-D 4020, an average particle size between about 300 microns and about 1500 microns, and a bulk density between about 0.25 g/ml and about 0.5 g/ml.

In some embodiments, the binder particles are a combination of various binder particles as distinguished by composition, shape, size, bulk density, MFI, intrinsic viscosity, and the like, and any combination thereof.

In some embodiments, the porous mass section may comprise active particles in an amount ranging from a lower limit of about 1 wt %, 5 wt %, 10 wt %, 25 wt %, 40 wt %, 50 wt %, 60 wt %, or 75 wt % of the porous mass section to an upper limit of about 99 wt %, 95 wt %, 90 wt %, or 75 wt % of the porous mass section, and wherein the amount of active particles can range from any lower limit to any upper limit and encompass any subset therebetween. In some embodiments, the porous mass section may comprise binder particles in an amount ranging from a lower limit of about 1 wt %, 5 wt %, 10 wt %, or 25 wt % of the porous mass section to an upper limit of about 99 wt %, 95 wt %, 90 wt %, 75 wt %, 60 wt %, 50 wt %, 40 wt %, or 25 wt % of the porous mass section, and wherein the amount of binder particles can range from any lower limit to any upper limit and encompass any subset therebetween.

In some embodiments, the porous mass sections may further comprise an active coating disposed on at least a portion of the active particles and binder particles. As used herein, the term "coating," and the like, does not imply any particular degree of coating on a surface. In particular, the terms "coat" or "coating" do not imply 100% coverage by the coating on a surface. One of ordinary skill in the art should understand that the active coating should be included in an amount and applied via a method that minimal affects the efficacy of active particles. For example, activated carbon may be especially sensitive and the choice of an active coating, amount of an active coating, and method of applying the active coating should be carefully considered.

Active coatings may, in some embodiments, be useful in reducing the concentration of contaminants in a smoke stream. Examples of active coatings may include, but are not limited to, triacetin, malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate, carboxylated acrylate, liquid amines, vitamin E, triethyl citrate, acetyl triethyl citrate, tributyl citrate acetyl tributyl citrate, acetyl tri-2-ethylhexyl, non-ionic surfactants (e.g., polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, and any combination thereof.

In some embodiments, the active coatings may be chosen to reduce the concentration of phenols in a smoke stream. Phenols are known to be significant contributors to the harshness and irritation of cigarette smoke. Without being limited by theory, it is believed that by replacing a portion of a traditional cellulose acetate filter with a porous mass, the total amount of carbonyl groups associated with the triacetin and the cellulose acetate in the cigarette filter is reduced, and consequently the filtration efficacy for phenols is also reduced. Additionally, incorporation of active coatings suitable for reducing phenols into one or more segments of a filter may provide for smoking device filters with similar or greater efficacy to phenol reduction. Examples of active coatings suitable for the reduction of phenols in a smoke stream may include, but are not limited to, triacetin e.g., triacetin, triethyl citrate, acetyl triethyl citrate, tributyl citrate acetyl tributyl citrate, acetyl tri-2-ethylhexyl, non-ionic surfactants (e.g., polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, and the like, and any combination thereof. Additionally, cellulose acetate flake or filaments may, in some instances, be included in the porous mass to reduce phenols in the smoke stream.

In some embodiments, active coatings may be included in porous masses described herein in an amount ranging from a lower limit of about 0.5%, 1%, 2%, 3%, 6%, or 10% by weight of the porous mass to an upper limit of about 15%, 13%, 10%, or 8% by weight of the porous mass, and wherein the amount may range from any lower limit to any upper limit and encompasses any subset therebetween.

Addition of an active coating may be performed after formation of the porous mass, i.e., after mechanically binding the active particles and the binder particles. Application of the active coating may be by liquid injection, dipping, spraying, super critical fluid deposition, or the like. In some embodiments, the porous masses may be dried after application of the active coating.

As described above, the smoke filters described herein comprise at least one porous mass section and at least one filter section. In some embodiments, the filter sections may comprise at least one of cellulose, cellulosic derivatives, cellulose ester tow, cellulose acetate tow, cellulose acetate tow with less than about 10 denier per filament, cellulose acetate tow with about 10 denier per filament or greater, random oriented acetates, papers, corrugated papers, polypropylene, polyethylene, polyolefin tow, polypropylene tow, polyethylene terephthalate, polybutylene terephthalate, coarse powders, carbon particles, carbon fibers, fibers, glass beads, zeolites, molecular sieves, and any combination thereof.

In some embodiments, the filter sections may further comprise active dopants. Active dopants may, in some embodiments, be useful in reducing the concentration of contaminants in a smoke stream. In some embodiments, the active dopants may form a coating on at least a portion of another surface in the filter section (e.g., papers) and/or may absorb into another structure in the filter section (e.g., cellulose ester tow).

Examples of active dopants may include, but are not limited to, triacetin, malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate, carboxylated acrylate, vitamin E, triethyl citrate, acetyl triethyl citrate, tributyl citrate acetyl tributyl citrate, acetyl tri-2-ethylhexyl, non-ionic surfactants (e.g., polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, and any combination thereof.

In some embodiments, the active dopants may be chosen to reduce the concentration of phenols from a smoke stream. Examples of active dopants may include, but are not limited to, triacetin, triethyl citrate, acetyl triethyl citrate, tributyl citrate acetyl tributyl citrate, acetyl tri-2-ethylhexyl, non-ionic surfactants (e.g., polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, and the like, and any combination thereof.

In some embodiments, active dopants may be included in filter sections described herein in an amount ranging from a lower limit of about 3%, 6%, or 10% by weight of the unwrapped filter section to an upper limit of about 15%, 13%, or 10% by weight of the unwrapped filter section, and wherein the amount may range from any lower limit to any upper limit and encompasses any subset therebetween.

In some embodiments, filter sections may further comprise active particles described herein, e.g., for further reducing the concentration of contaminants in a smoke stream.

In some instances, the active particles, active coatings, and active dopants in porous masses and/or filter sections may individually be suitable for reducing the concentration of at least one of the following contaminants of a smoke stream: acetaldehyde, acetamide, acetone, acrolein, acrylamide, acrylonitrile, aflatoxin B-1, 4-aminobiphenyl, 1-anninonaphthalene, 2-aminonaphthalene, ammonia, ammonium salts, anabasine, anatabine, O-anisidine, arsenic, A-α-C, benz[a]anthracene, benz[b]fluoroanthene, benz[j]aceanthrylene, benz[k]fluoroanthene, benzene, benzo[b]furan, benzo[a]pyrene, benzo[c]phenanthrene, beryllium, 1,3-butadiene, butyraldehyde, cadmium, caffeic acid, carbon monoxide, catechol, chlorinated dioxins/furans, chromium, chrysene, cobalt, coumarin, a cresol, crotonaldehyde, cyclopenta[c,d]pyrene, dibenz(a,h)acridine, dibenz(a,j)acridine, dibenz[a,h]anthracene, dibenzo(c,g)carbazole, dibenzo[a,e]pyrene, dibenzo[a,h]pyrene, dibenzo[a,i]pyrene, dibenzo[a,l]pyrene, 2,6-dimethylaniline, ethyl carbamate (urethane), ethylbenzene, ethylene oxide, eugenol, formaldehyde, furan, glu-P-1, glu-P-2, hydrazine, hydrogen cyanide, hydroquinone, indeno[1,2,3-cd]pyrene, IQ, isoprene, lead, MeA-α-C, mercury, methyl ethyl ketone, 5-methylchrysene, 4-(methylnitrosamino)-1-(3-pyridyl)-1-butanone (NNK), 4-(methylnitrosamino)-1-(3-pyridyl)-1-butanol (NNAL), naphthalene, nickel, nicotine, nitrate, nitric oxide, a nitrogen oxide, nitrite, nitrobenzene, nitromethane, 2-nitropropane, N-nitrosoanabasine (NAB), N-nitrosodiethanolamine (NDELA), N-nitrosodiethylamine, N-nitrosodimethylamine (NDMA), N-nitrosoethylmethylamine, N-nitrosomorpholine (NMOR), N-nitrosonornicotine (NNN), N-nitrosopiperidine (NPIP), N-nitrosopyrrolidine (NPYR), N-nitrososarcosine (NSAR), phenol, PhIP, polonium-210 (radio-isotope), propionaldehyde, propylene oxide, pyridine, quinoline, resorcinol, selenium, styrene, tar, 2-toluidine, toluene, Trp-P-1, Trp-P-2, uranium-235 (radio-isotope), uranium-238 (radio-isotope), vinyl acetate, vinyl chloride, and any combination thereof. In some instances, within a single filter, the active particles, active coatings, and active dopants in porous masses and/or filter sections may be for reducing the same or different smoke stream contaminants. In some embodiments, the reduction of carbon monoxide in a smoke stream may be achieved with porous mass sections and/or filter sections comprising iodine pentoxide, phosphorous pentoxide, manganese oxide, copper oxide, iron oxide, molecular sieves, aluminum oxide, gold, platinum, and the like, and any combination thereof. In some embodiments, the reduction of phenols in a smoke stream may be achieved with porous mass sections and/or filter sections comprising triacetin, triethyl citrate, acetyl triethyl citrate, tributyl citrate acetyl tributyl citrate, acetyl tri-2-ethylhexyl, non-ionic surfactants (e.g., polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, cellulose acetate, and the like, and any combination thereof.

In some embodiments, the porous mass sections and filter sections may independently have features like a concentric filter design, a paper wrapping, a cavity, a void chamber, a baffled void chamber, capsules, channels, and the like, and any combination thereof.

In some embodiments, the porous masses may comprise active particles in an amount ranging from a lower limit of about 1 wt %, 5 wt %, 10 wt %, 25 wt %, 40 wt %, 50 wt %, 60 wt %, or 75 wt % of the porous mass to an upper limit of about 99 wt %, 95 wt %, 90 wt %, or 75 wt % of the porous mass, and wherein the amount of active particles can range from any lower limit to any upper limit and encompass any subset therebetween. In some embodiments, the porous masses may comprise binder particles in an amount ranging from a lower limit of about 1 wt %, 5 wt %, 10 wt %, or 25 wt % of the porous mass to an upper limit of about 99 wt %, 95 wt %, 90 wt %, 75 wt %, 60 wt %, 50 wt %, 40 wt %, or 25 wt % of the porous mass, and wherein the amount of binder particles can range from any lower limit to any upper limit and encompass any subset therebetween.

While the ratio of binder particle size to active particle size can include any iteration as dictated by the size ranges for each described herein, specific size ratios may be advantageous for specific applications and/or products. By way of nonlimiting example, in smoking device filters the sizes of the active particles and binder particles should be such that the EPD allows for drawing fluids through the porous mass. In some embodiments, the ratio of binder particle size to active particle size may range from about 10:1 to about 1:10, or more preferably range from about 1:1.5 to about 1:4.

In some embodiments, porous masses may have a void volume in the range of about 40% to about 90%. In some embodiments, porous masses may have a void volume of about 60% to about 90%. In some embodiments, porous masses may have a void volume of about 60% to about 85%. Void volume is the free space left after accounting for the space taken by the active particles.

To determine void volume, although not wishing to be limited by any particular theory, it is believed that testing indicates that the final density of the mixture was driven almost entirely by the active particle; thus, the space occupied by the binder particles was not considered for this calculation. Thus, void volume, in this context, is calculated based on the space remaining after accounting for the active particles. To determine void volume, first the upper and lower diameters based on the mesh size were averaged for the active particles, and then the volume was calculated (assuming a spherical shape based on that averaged diameter) using the density of the active material. Then, the percentage void volume is calculated as follows:

$$\text{Void Volume (\%)} = \frac{\left(\left[(\text{porous mass volume, cm}^3) - (\text{weight of active particles, } gm)/(\text{density of the active particles, } gm/\text{cm}^3)\right] * 100\right)}{(\text{porous mass volume, cm}^3)}$$

When the filter sections comprise active dopants, active particles, and some of the features, the EPD (i.e., draw characteristics) of the smoke filter may be changed. Advantageously, the EPD of the porous mass sections described herein may be tailored by changing, inter alia, the binder particle size, the active particle size, and the like, to compensate for the EPD change in the filter section. In some embodiments, porous masses may have an active particle loading of at least about 1 mg/mm, 2 mg/mm, 3 mg/mm, 4 mg/mm, 5 mg/mm, 6 mg/mm, 7 mg/mm, 8 mg/mm, 9 mg/mm, 10 mg/mm, 11 mg/mm, 12 mg/mm, 13 mg/mm, 14 mg/mm, 15 mg/mm, 16 mg/mm, 17 mg/mm, 18 mg/mm, 19 mg/mm, 20 mg/mm, 21 mg/mm, 22 mg/mm, 23 mg/mm, 24 mg/mm, or 25 mg/mm in combination with an EPD of less than about 20 mm of water or less per mm of length, 19 mm of water or less per mm of length, 18 mm of water or less per mm of length, 17 mm of water or less per mm of length, 16 mm of water or less per mm of length, 15 mm of water or less per mm of length, 14 mm of water or less per mm of length, 13 mm of water or less per mm of length, 12 mm of water or less per mm of length, 11 mm of water or less per mm of length, 10 mm of water or less per mm of length, 9 mm of water or less per mm of length, 8 mm of water or less per mm of length, 7 mm of water or less per mm of length, 6 mm of water or less per mm of length, 5 mm of water or less per mm of length, 4 mm of water or less per mm of length, 3 mm of water or less per mm of length, 2 mm of water or less per mm of length, or 1 mm of water or less per mm of length, and wherein the active particle loading and the EPD may independently range from any lower limit to any upper limit and encompass any subset therebetween.

By way of example, in some embodiments, porous masses may have an active particle loading of at least about 1 mg/mm and an EPD of about 20 mm of water or less per mm of length. In other embodiments, the porous mass may have an active particle loading of at least about 1 mg/mm and an EPD of about 20 mm of water or less per mm of length, wherein the active particle is not carbon. In other embodiments, the porous mass may have an active particle comprising carbon with a loading of at least 6 mg/mm in combination with an EPD of 10 mm of water or less per mm of length.

Further, within the filter, the length of the porous mass sections and the filter sections to achieve a desired smoke filter length and EPD. In some embodiments, smoke filters described herein may have an EPD in ranging from a lower limit of about 0.10 mm of water per mm of length, 1 mm of water per mm of length, 2 mm of water per mm of length, 3 mm of water per mm of length, 4 mm of water per mm of length, 5 mm of water per mm of length, 6 mm of water per mm of length, 7 mm of water per mm of length, 8 mm of water per mm of length, 9 mm of water per mm of length, or 10 mm of water per mm of length to an upper limit of about 20 mm of water per mm of length, 19 mm of water per mm of length, 18 mm of water per mm of length, 17 mm of water per mm of length, 16 mm of water per mm of length, 15 mm of water per mm of length, 14 mm of water per mm of length, 13 mm of water per mm of length, 12 mm of water per mm of length, 11 mm of water per mm of length, 10 mm of water per mm of length, 9 mm of water per mm of length, 8 mm of water per mm of length, 7 mm of water per mm of length, 6 mm of water per mm of length, or 5 mm of water per mm of length, wherein the EPD may range from any lower limit to any upper limit and encompass any subset therebetween.

In some embodiments, the filter may have a structure with a first other filter segment proximal to the mouth end of the smoking device. In some embodiments, the filter may comprise two or more sections in any desired order, e.g., in order a first filter section (e.g., cellulose acetate tow), a porous mass, and a second filter section (e.g., cellulose acetate tow) or in order a first filter section (e.g., cellulose acetate tow), a first porous mass (e.g., comprising activated carbon), a second porous mass (e.g., comprising phenol and/or carbon monoxide reducing active particles and/or active coatings), and a second filter section (e.g., cellulose acetate tow comprising phenol and/or carbon monoxide reducing active particles and/or active dopants). Within a structure, the length and composition of individual sections may be chosen to achieve a desired EPD and smoke stream component reduction. One skilled in the art with the benefit of this disclosure should understand the multitude of structures for the smoke filter described herein.

In some embodiments, a smoking device may comprise a smokeable substance in fluid communication with a smoke filter according to any of the embodiments described herein (e.g., comprising porous mass sections with active particles described herein, binder particles described herein, optionally active coatings described herein, optionally additives described herein, optionally with features described herein, and the like; comprising filter sections with materials described herein, optionally dopants described herein, optionally additives described herein, optionally with features described herein, and the like; having an EPD described herein; having a structure described herein; and the like).

As used herein, the term "smokeable substance" refers to a material capable of producing smoke when burned or heated. Suitable smokeable substances may include, but not be limited to, tobaccos, e.g., bright leaf tobacco, Oriental tobacco, Turkish tobacco, Cavendish tobacco, corojo tobacco, criollo tobacco, Perique tobacco, shade tobacco, white burley tobacco, flue-cured tobacco, Burley tobacco, Maryland tobacco, Virginia tobacco; teas; herbs; carbonized or pyrolyzed components; inorganic filler components; or any combination thereof. Tobacco may have the form of tobacco laminae in cut filler form, processed tobacco stems, reconstituted tobacco filler, volume expanded tobacco filler, or the like. Tobacco, and other grown smokeable substances, may be grown in the United States, or may be grown in a jurisdiction outside the United States.

In some embodiments, a smokeable substance may be in a column format, e.g., a tobacco column. As used herein, the term "tobacco column" refers to the blend of tobacco, and optionally other ingredients and flavorants that may be combined to produce a tobacco-based smokeable article, such as a cigarette or cigar. In some embodiments, the tobacco column may comprise ingredients selected from the group consisting of: tobacco, sugar (such as sucrose, brown sugar, invert sugar, or high fructose corn syrup), propylene glycol, glycerol, cocoa, cocoa products, carob bean gums, carob bean extracts, and any combination thereof. In still other embodiments, the tobacco column may further comprise flavorants, aromas, menthol, licorice extract, diammonium phosphate, ammonium hydroxide, and any combination thereof. In some embodiments, tobacco columns may comprise additives. In some embodiments, tobacco columns may comprise at least one bendable element.

In some embodiments, a smoking device may comprise a housing operably capable of maintaining the smoke filter in fluid communication with a smokeable substance.

Suitable housings may include, but not be limited to, cigarettes, cigarette holders, cigars, cigar holders, pipes, water pipes, hookahs, electronic smoking devices, roll-your-own cigarettes, roll-your-own cigars, papers, or any combination thereof.

In some embodiments, a pack may comprise at least one smoke filter according to any of the embodiments described herein (e.g., comprising porous mass sections with active particles described herein, binder particles described herein, optionally active coatings described herein, optionally additives described herein, optionally with features described herein, and the like; comprising filter sections with materials described herein, optionally dopants described herein, optionally additives described herein, optionally with features described herein, and the like; having an EPD described herein; having a structure described herein; and the like). The pack may be a hinge-lid pack, a slide-and-shell pack, a hard cup pack, a soft cup pack, or any other suitable pack container. In some embodiments, the packs may have an outer wrapping, such as a polypropylene wrapper, and optionally a tear tab. In some embodiments, the smoke filters may be sealed as a bundle inside a pack. A bundle may contain a number of filters, for example, 20 or more. However, a bundle may include a single smoke filter, in some embodiments, such as exclusive smoke filter embodiments like those for individual sale, or a smoke filter comprising a specific spice, like vanilla, clove, or cinnamon.

In some embodiments, a pack may comprise at least one smoking device comprising a smoke filter according to any of the embodiments described herein (e.g., comprising porous mass sections with active particles described herein, binder particles described herein, optionally active coatings described herein, optionally additives described herein, optionally with features described herein, and the like; comprising filter sections with materials described herein, optionally dopants described herein, optionally additives described herein, optionally with features described herein, and the like; having an EPD described herein; having a structure described herein; and the like). The pack may be a hinge-lid pack, a slide-and-shell pack, a hard cup pack, a soft cup pack, or any other suitable pack container. In some embodiments, the packs may have an outer wrapping, such as a polypropylene wrapper, and optionally a tear tab. In some embodiments, the smoke filters may be sealed as a bundle inside a pack. A bundle may contain a number of filters, for example, 20 or more. However, a bundle may include a single smoke filter, in some embodiments, such as exclusive smoke filter embodiments like those for individual sale, or a smoke filter comprising a specific spice, like vanilla, clove, or cinnamon.

In some embodiments, a carton may comprise at least one pack comprising at least one smoking device comprising a smoke filter according to any of the embodiments described herein (e.g., comprising porous mass sections with active particles described herein, binder particles described herein, optionally active coatings described herein, optionally additives described herein, optionally with features described herein, and the like; comprising filter sections with materials described herein, optionally dopants described herein, optionally additives described herein, optionally with features described herein, and the like; having an EPD described herein; having a structure described herein; and the like). In some embodiments, the carton (e.g., a container) has the physical integrity to contain the weight from the packs of smoking devices. This may be accomplished through thicker cardstock being used to form the carton or stronger adhesives being used to bind elements of the carton.

Because it is expected that a consumer will smoke a smoking device that includes a porous mass as described herein, the present invention also provides methods of smoking such a smoking device. For example, in one embodiment, the present invention provides a method of smoking a smoking device comprising: heating or lighting a smoking device to form smoke, the smoking device comprising a smoke filter according to any of the embodiments described herein (e.g., comprising porous mass sections with active particles described herein, binder particles described herein, optionally active coatings described herein, optionally additives described herein, optionally with features described herein, and the like; comprising filter sections with materials described herein, optionally dopants described herein, optionally additives described herein, optionally with features described herein, and the like; having an EPD described herein; having a structure described herein; and the like).

The process of forming porous masses may include continuous processing methods, batch processing methods, or hybrid continuous-batch processing methods. As used herein, "continuous processing" refers to manufacturing or producing materials without interruption. Material flow may be continuous, indexed, or combinations of both. As used herein, "batch processing" refers to manufacturing or producing materials as a single component or group of components at individual stations before the single component or group proceeds to the next station. As used herein, "continuous-batch processing" refers to a hybrid of the two where some processes, or series of processes, occur continuously and others occur by batch.

Generally, porous masses may be formed from matrix materials. As used herein, the term "matrix material" refers to the precursors, e.g., binder particles and active particles, used to form porous masses. In some embodiments, the matrix material may comprise, consist of, or consist essentially of binder particles and active particles. In some embodiments, the matrix material may comprise binder particles, active particles, and additives. Nonlimiting examples of suitable binder particles, active particles, and additives are provided in this disclosure.

Forming porous masses may generally include forming a matrix material into a desired shape (e.g., suitable for incorporating into as smoking device filter, a water filter, an air filter, or the like) and mechanically bonding (e.g., sintering) at least a portion of the matrix material at a plurality of contact points.

Forming a matrix material into a shape may involve a mold cavity. In some embodiments, a mold cavity may be a single piece or a collection of single pieces, either with or without end caps, plates, or plugs. In some embodiments, a mold cavity may be multiple mold cavity parts that when assembled form a mold cavity. In some embodiments, mold cavity parts may be brought together with the assistance of conveyors, belts, and the like. In some embodiments, mold cavity parts may be stationary along the material path and configured to allow for conveyors, belts, and the like to pass therethrough, where the mold cavity may expand and contract radially to provide a desired level of compression to the matrix material.

In some embodiments, mold cavities may be at least partially lined with wrappers and/or coated with release agents. In some embodiments, wrappers may be individual wrappers, e.g., pieces of paper. In some embodiments, wrappers may be spoolable-length wrappers, e.g., a 50 ft roll of paper.

In some embodiments, mold cavities may be lined with more than one wrapper. In some embodiments, forming porous masses may include lining a mold cavity(s) with a wrapper(s). In some embodiments, forming porous masses may include wrapping the matrix material with wrappers so that the wrapper effectively forms the mold cavity. In such embodiments, the wrapper may be performed as a mold cavity, formed as a mold cavity in the presence of the matrix material, or wrapped around matrix material that is in a preformed shape (e.g., with the aid of a tackifier). In some embodiments, wrappers may be continuously fed through a mold cavity. Wrappers may be capable of holding the porous mass in a shape, capable of releasing the porous masses from the mold cavities, capable of assisting in passing matrix material through the mold cavity, capable of protecting the porous mass during handling or shipment, and any combination thereof.

Suitable wrappers may include, but not be limited to, papers (e.g., wood-based papers, papers containing flax, flax papers, papers produced from other natural or synthetic fibers, functionalized papers, special marking papers, colorized papers), plastics (e.g., fluorinated polymers like polytetrafluoroethylene, silicone), films, coated papers, coated plastics, coated films, and the like, and any combination thereof. In some embodiments, wrappers may be papers suitable for use in smoking device filters.

Suitable release agents may be chemical release agents or physical release agents. Nonlimiting examples of chemical release agents may include oils, oil-based solutions and/or suspensions, soapy solutions and/or suspensions, coatings bonded to the mold surface, and the like, and any combination thereof. Nonlimiting examples of physical release agents may include papers, plastics, and any combination thereof. Physical release agents, which may be referred to as release wrappers, may be implemented similar to wrappers as described herein.

Once formed into a desired cross-sectional shape with the mold cavity, the matrix material may be mechanically bound at a plurality of contact points. Mechanical bonding may occur during and/or after the matrix material is in the mold cavity. Mechanical bonding may be achieved with heat and/or pressure and without adhesive (i.e., forming a sintered contact points). In some instances, an adhesive may optionally be included.

Heat may be radiant heat, conductive heat, convective heat, and any combination thereof. Heating may involve thermal sources including, but not limited to, heated fluids internal to the mold cavity, heated fluids external to the mold cavity, steam, heated inert gases, secondary radiation from a component of the porous mass (e.g., nanoparticles, active particles, and the like), ovens, furnaces, flames, conductive or thermoelectric materials, ultrasonics, and the like, and any combination thereof. By way of nonlimiting example, heating may involve a convection oven or heating block. Another nonlimiting example may involve heating with microwave energy (single-mode or multi-mode applicator). In another nonlimiting example, heating may involve passing heated air, nitrogen, or other gas through the matrix material while in the mold cavity. In some embodiments, heated inert gases may be used to mitigate any unwanted oxidation of active particles and/or additives. Another nonlimiting example may involve mold cavities made of thermoelectric materials so that the mold cavity heats. In some embodiments, heating may involve a combination of the foregoing, e.g., passing heated gas through the matrix material while passing the matrix material through a microwave oven.

In some embodiments, heating to facilitate mechanical bonding may be to a softening temperature of a component of the matrix material. As used herein, the term "softening temperature" refers to the temperature above which a material becomes pliable, which is typically below the melting point of the material.

In some embodiments, mechanical bonding may be achieved at temperatures ranging from a lower limit of about 90° C., 100° C., 110° C., 120° C., 130° C., or 140° C. or an upper limit of about 300° C., 275° C., 250° C., 225° C., 200° C., 175° C., or 150° C., and wherein the temperature may range from any lower limit to any upper limit and encompass any subset therebetween. In some embodiments, the heating may be accomplished by subjecting material to a single temperature. In another embodiment the temperature profile may vary with time. By way of nonlimiting example, a convection oven may be used. In some embodiments, heating may be localized within the matrix material. By way of nonlimiting example, secondary radiation from nanoparticles may heat only the matrix material proximal to the nanoparticle.

In some embodiments, matrix materials may be preheated before entering mold cavities. In some embodiments, matrix material may be preheated to a temperature below the softening temperature of a component of the matrix material. In some embodiments, matrix material may be preheated to a temperature about 10%, about 5%, or about 1% below the softening temperature of a component of the matrix material. In some embodiments, matrix material may be preheated to a temperature about 10° C., about 5° C., or about 1° C. below the softening temperature of a component of the matrix material. Preheating may involve heat sources including, but not limited to, those listed as heat sources above for achieving mechanical bonding.

In some embodiments, bonding the matrix material may yield porous mass or porous mass lengths. As used herein, the term "porous mass length" refers to a continuous porous mass (i.e., a porous mass that is not never-ending, but rather long compared to porous masses, which may be produced continuously). By way of nonlimiting example, porous mass lengths may be produced by continuously passing matrix material through a heated mold cavity. In some embodiments, the binder particles may retain their original physical shape (or substantially retained their original shape, e.g., no more that 10% variation (e.g., shrinkage) in shape from original) during the mechanical bonding process, i.e., the binder particles may be substantially the same shape in the matrix material and in the porous mass (or lengths). For simplicity and readability, unless otherwise specified, the term "porous mass" encompasses porous mass sections, porous masses, and porous mass lengths (wrapped or otherwise).

In some embodiments, porous mass lengths may be cut to yield porous mass. Some embodiments may involve cutting porous masses and/or porous mass lengths radially to yield porous masses and/or porous mass sections. One skilled in the art would recognize how radial cutting translates to and encompasses the cutting of shapes like sheets. Cutting may be achieved by any known method with any known apparatus including, but not limited to, those described above in relation to cutting porous mass lengths into porous masses.

In some embodiments, porous masses and/or porous mass lengths may be extruded. In some embodiments, extrusion may involve a die. In some embodiments, a die may have multiple holes being capable of extruding porous masses and/or porous mass lengths.

Some embodiments may involve wrapping porous masses with a wrapper after the matrix material has been mechanically bound, e.g., after removal from the mold cavity or exiting an extrusion die. Suitable wrappers include those disclosed above.

Some embodiments may involve cooling porous masses. Cooling may be active or passive, i.e., cooling may be assisted or occur naturally.

Additional details regarding the production of porous masses described herein include those disclosed in U.S. patent application Ser. No. 14/049,404 and U.S. Patent Application Publication No. 2013/0032158, each of which are incorporated herein by reference.

Additives

In some embodiments, porous masses may comprise active particles, binder particles, and additives. In some embodiments, the matrix material or porous masses may comprise additives in an amount ranging from a lower limit of about 0.01 wt %, 0.05 wt %, 0.1 wt %, 1 wt %, 5 wt %, or 10 wt % of the matrix material or porous masses to an upper limit of about 25 wt %, 15 wt %, 10 wt %, 5 wt %, or 1 wt % of the matrix material or porous masses, and wherein the amount of additives can range from any lower limit to any upper limit and encompass any subset therebetween. It should be noted that porous masses as referenced herein include porous mass lengths, porous masses, and porous mass sections (wrapped or otherwise).

Suitable additives may include, but not be limited to, active compounds, ionic resins, zeolites, nanoparticles, microwave enhancement additives, ceramic particles, glass beads, softening agents, plasticizers, pigments, dyes, flavorants, aromas, controlled release vesicles, adhesives, tackifiers, surface modification agents, vitamins, peroxides, biocides, antifungals, antimicrobials, antistatic agents, flame retardants, degradation agents, and any combination thereof.

Suitable ionic resins may include, but not be limited to, polymers with a backbone, such as styrene-divinyl benzene (DVB) copolymer, acrylates, methacrylates, phenol formaldehyde condensates, and epichlorohydrin amine condensates; a plurality of electrically charged functional groups attached to the polymer backbone; and any combination thereof.

Zeolites may include crystalline aluminosilicates having pores, e.g., channels, or cavities of uniform, molecular-sized dimensions. Zeolites may include natural and synthetic materials. Suitable zeolites may include, but not be limited to, zeolite BETA ($Na_7(Al_7Si_{57}O_{128})$ tetragonal), zeolite ZSM-5 ($Na_n(Al_nSi_{96-n}O_{192})$ $16H_2O$, with n<27), zeolite A, zeolite X, zeolite Y, zeolite K-G, zeolite ZK-5, zeolite ZK-4, mesoporous silicates, SBA-15, MCM-41, MCM48 modified by 3-aminopropylsilyl groups, alumino-phosphates, mesoporous aluminosilicates, other related porous materials (e.g., such as mixed oxide gels), and any combination thereof.

Suitable nanoparticles may include, but not be limited to, nano-scaled carbon particles like carbon nanotubes of any number of walls, carbon nanohorns, bamboo-like carbon nanostructures, fullerenes and fullerene aggregates, and graphene including few layer graphene and oxidized graphene; metal nanoparticles like gold and silver; metal oxide nanoparticles like alumina, silica, and titania; magnetic, paramagnetic, and superparamagnetic nanoparticles like gadolinium oxide, various crystal structures of iron oxide like hematite and magnetite, about 12 nm $Fe_3O_4$, gado-nanotubes, and endofullerenes like $Gd@C_{60}$; and core-shell and onionated nanoparticles like gold and silver nanoshells, onionated iron oxide, and other nanoparticles or microparticles with an outer shell of any of said materials) and any combination of the foregoing (including activated carbon). It should be noted that nanoparticles may include nanorods, nanospheres, nanorices, nanowires, nanostars (like nanotripods and nanotetrapods), hollow nanostructures, hybrid nanostructures that are two or more nanoparticles connected as one, and non-nano particles with nano-coatings or nano-thick walls. It should be further noted that nanoparticles may include the functionalized derivatives of nanoparticles including, but not limited to, nanoparticles that have been functionalized covalently and/or non-covalently, e.g., pi-stacking, physisorption, ionic association, van der Waals association, and the like. Suitable functional groups may include, but not be limited to, moieties comprising amines (1°, 2°, or 3°), amides, carboxylic acids, aldehydes, ketones, ethers, esters, peroxides, silyls, organosilanes, hydrocarbons, aromatic hydrocarbons, and any combination thereof; polymers; chelating agents like ethylenediamine tetraacetate, diethylenetriaminepentaacetic acid, triglycollamic acid, and a structure comprising a pyrrole ring; and any combination thereof. Functional groups may enhance removal of smoke components and/or enhance incorporation of nanoparticles into a porous mass.

Suitable microwave enhancement additives may include, but not be limited to, microwave responsive polymers, carbon particles, fullerenes, carbon nanotubes, metal nanoparticles, water, and the like, and any combination thereof.

Suitable ceramic particles may include, but not be limited to, oxides (e.g., silica, titania, alumina, beryllia, ceria, and zirconia), nonoxides (e.g., carbides, borides, nitrides, and silicides), composites thereof, and any combination thereof. Ceramic particles may be crystalline, non-crystalline, or semi-crystalline.

As used herein, pigments refer to compounds and/or particles that impart color and are incorporated throughout the matrix material and/or a component thereof. Suitable pigments may include, but not be limited to, titanium dioxide, silicon dioxide, tartrazine, E102, phthalocyanine blue, phthalocyanine green, quinacridones, perylene tetracarboxylic acid di-imides, dioxazines, perinones disazo pigments, anthraquinone pigments, carbon black, titanium dioxide, metal powders, iron oxide, ultramarine, and any combination thereof.

As used herein, dyes refer to compounds and/or particles that impart color and are a surface treatment. Suitable dyes may include, but not be limited to, CARTASOL® dyes (cationic dyes, available from Clariant Services) in liquid and/or granular form (e.g., CARTASOL® Brilliant Yellow K-6G liquid, CARTASOL® Yellow K-4GL liquid, CARTASOL® Yellow K-GL liquid, CARTASOL® Orange K-3GL liquid, CARTASOL® Scarlet K-2GL liquid, CARTASOL® Red K-3BN liquid, CARTASOL® Blue K-5R liquid, CARTASOL® Blue K-RL liquid, CARTASOL® Turquoise K-RL liquid/granules, CARTASOL® Brown K-BL liquid), FASTUSOL® dyes (an auxochrome, available from BASF) (e.g., Yellow 3GL, Fastusol C Blue 74L).

Suitable flavorants may be any flavorant suitable for use in smoking device filters including those that impart a taste and/or a flavor to the smoke stream. Suitable flavorants may include, but not be limited to, organic material (or naturally flavored particles), carriers for natural flavors, carriers for artificial flavors, and any combination thereof. Organic materials (or naturally flavored particles) include, but are not limited to, tobacco, cloves (e.g., ground cloves and clove flowers), cocoa, coffee, teas, and the like. Natural and artificial flavors may include, but are not limited to, menthol, cloves, cherry, chocolate, orange, mint, mango, vanilla, cinnamon, tobacco, and the like. Such flavors may be provided by menthol, anethole (licorice), anisole, limonene (citrus), eugenol (clove), and the like, and any combination thereof. In some embodiments, more than one flavorant may be used including any combination of the flavorants provided herein. These flavorants may be placed in the tobacco column or in a section of a filter. Additionally, in some embodiments, the porous masses of the present invention may comprise a flavorant. The amount to include will depend on the desired level of flavor in the smoke taking into account all filter sections, the length of the smoking device, the type of smoking device, the diameter of the smoking device, as well as other factors known to those of skill in the art.

Suitable aromas may include, but not be limited to, methyl formate, methyl acetate, methyl butyrate, ethyl acetate, ethyl butyrate, isoamyl acetate, pentyl butyrate, pentyl pentanoate, octyl acetate, myrcene, geraniol, nerol, citral, citronellal, citronellol, linalool, nerolidol, limonene, camphor, terpineol, alpha-ionone, thujone, benzaldehyde, eugenol, cinnamaldehyde, ethyl maltol, vanilla, anisole, anethole, estragole, thymol, furaneol, methanol, spices, spice extracts, herb extracts, essential oils, smelling salts, volatile organic compounds, volatile small molecules, methyl formate, methyl acetate, methyl butyrate, ethyl acetate, ethyl butyrate, isoamyl acetate, pentyl butyrate, pentyl pentanoate, octyl acetate, myrcene, geraniol, nerol, citral, citronellal, citronellol, linalool, nerolidol, limonene, camphor, terpineol, alpha-ionone, thujone, benzaldehyde, eugenol, cinnamaldehyde, ethyl maltol, vanilla, anisole, anethole, estragole, thymol, furaneol, methanol, rosemary, lavender, citrus, freesia, apricot blossoms, greens, peach, jasmine, rosewood, pine, thyme, oakmoss, musk, vetiver, myrrh, blackcurrant, bergamot, grapefruit, acacia, passiflora, sandalwood, tonka bean, mandarin, neroli, violet leaves, gardenia, red fruits, ylang-ylang, acacia farnesiana, mimosa, tonka bean, woods, ambergris, daffodil, hyacinth, narcissus, black currant bud, iris, raspberry, lily of the valley, sandalwood, vetiver, cedarwood, neroli, bergamot, strawberry, carnation, oregano, honey, civet, heliotrope, caramel, coumarin, patchouli, dewberry, helonial, bergamot, hyacinth, coriander, pimento berry, labdanum, cassie, bergamot, aldehydes, orchid, amber, benzoin, orris, tuberose, palmarosa, cinnamon, nutmeg, moss, styrax, pineapple, bergamot, foxglove, tulip, wisteria, clematis, ambergris, gums, resins, civet, peach, plum, castoreum, myrrh, geranium, rose violet, jonquil, spicy carnation, galbanum, hyacinth, petitgrain, iris, hyacinth, honeysuckle, pepper, raspberry, benzoin, mango, coconut, hesperides, castoreum, osmanthus, mousse de chene, nectarine, mint, anise, cinnamon, orris, apricot, plumeria, marigold, rose otto, narcissus, tolu balsam, frankincense, amber, orange blossom, bourbon vetiver, opopanax, white musk, papaya, sugar candy, jackfruit, honeydew, lotus blossom, muguet, mulberry, absinthe, ginger, juniper berries, spicebush, peony, violet, lemon, lime, hibiscus, white rum, basil, lavender, balsamics, fo-ti-tieng, osmanthus, karo karunde, white orchid, calla lilies, white rose, rhubrum lily, tagetes, ambergris, ivy, grass, sering a, spearmint, clary sage, cottonwood, grapes, brimbelle, lotus, cyclamen, orchid, glycine, tiare flower, ginger lily, green osmanthus, passion flower, blue rose, bay rum, cassie, African tagetes, Anatolian rose, Auvergne narcissus, British broom, British broom chocolate, Bulgarian rose, Chinese patchouli, Chinese gardenia, Calabrian mandarin, Comoros Island tuberose, Ceylonese cardamom, Caribbean passion fruit, Damascena rose, Georgia peach, white Madonna lily, Egyptian jasmine, Egyptian marigold, Ethiopian civet, Farnesian cassie, Florentine iris, French jasmine, French jonquil, French hyacinth, Guinea oranges, Guyana wacapua, Grasse petitgrain, Grasse rose, Grasse tuberose, Haitian vetiver, Hawaiian pineapple, Israeli basil, Indian sandalwood, Indian Ocean vanilla, Italian bergamot, Italian iris, Jamaican pepper, May rose, Madagascar ylang-ylang, Madagascar vanilla, Moroccan jasmine, Moroccan rose, Moroccan oakmoss, Moroccan orange blossom, Mysore sandalwood, Oriental rose, Russian leather, Russian coriander, Sicilian mandarin, South African marigold, South American tonka bean, Singapore patchouli, Spanish orange blossom, Sicilian lime, Reunion Island vetiver, Turkish rose, That benzoin, Tunisian orange blossom, Yugoslavian oakmoss, Virginian cedarwood, Utah yarrow, West Indian rosewood, and the like, and any combination thereof.

Suitable tackifiers may include, but not be limited to, methylcellulose, ethylcellulose, hydroxyethylcellulose, carboxy methylcellulose, carboxy ethylcellulose, water-soluble cellulose acetate, amides, diamines, polyesters, polycarbonates, silyl-modified polyamide compounds, polycarbamates, urethanes, natural resins, shellacs, acrylic acid polymers, 2-ethylhexylacrylate, acrylic acid ester polymers, acrylic acid derivative polymers, acrylic acid homopolymers, anacrylic acid ester homopolymers, poly(methyl acrylate), poly(butyl acrylate), poly(2-ethylhexyl acrylate), acrylic acid ester copolymers, methacrylic acid derivative polymers, methacrylic acid homopolymers, methacrylic acid ester homopolymers, poly(methyl methacrylate), poly(butyl methacrylate), poly (2-ethylhexyl methacrylate), acrylamido-methyl-propane sulfonate polymers, acrylamido-methyl-propane sulfonate derivative polymers, acrylamido-methyl-propane sulfonate co-polymers, acrylic acid/acrylamido-methyl-propane sulfonate co-polymers, benzyl coco di-(hydroxyethyl) quaternary amines, p-T-amyl-phenols condensed with formaldehyde, dialkyl amino alkyl(meth)acrylates, acrylamides, N-(dialkyl amino alkyl) acrylamide, methacrylamides, hydroxy alkyl(meth)acrylates, methacrylic acids, acrylic acids, hydroxyethyl acrylates, and the like, any derivative thereof, and any combination thereof.

Suitable vitamins may include, but not be limited to, vitamin A, vitamin B1, vitamin B2, vitamin C, vitamin D, vitamin E, and any combination thereof.

Suitable antimicrobials may include, but not be limited to, anti-microbial metal ions, chlorhexidine, chlorhexidine salt, triclosan, polymoxin, tetracycline, amino glycoside (e.g., gentamicin), rifampicin, bacitracin, erythromycin, neomycin, chloramphenicol, miconazole, quinolone, penicillin, nonoxynol 9, fusidic acid, cephalosporin, mupirocin, metronidazolea secropin, protegrin, bacteriolcin, defensin, nitrofurazone, mafenide, acyclovir, vanocmycin, clindamycin, lincomycin, sulfonamide, norfloxacin, pefloxacin, nalidizic acid, oxalic acid, enoxacin acid, ciprofloxacin, polyhexamethylene biguanide (PHMB), PHMB derivatives (e.g., biodegradable biguanides like polyethylene hexamethylene biguanide (PEHMB)), clilorhexidine gluconate, chlorohexidine hydrochloride, ethylenediaminetetraacetic acid (EDTA), EDTA derivatives (e.g., disodium EDTA or tetrasodium EDTA), the like, and any combination thereof.

Antistatic agents may, in some embodiments, comprise any suitable anionic, cationic, amphoteric or nonionic antistatic agent. Anionic antistatic agents may generally include, but not be limited to, alkali sulfates, alkali phosphates, phosphate esters of alcohols, phosphate esters of ethoxylated alcohols, and any combination thereof. Examples may include, but not be limited to, alkali neutralized phosphate ester (e.g., TRYFAC® 5559 or TRYFRAC® 5576, available from Henkel Corporation, Mauldin, S.C.). Cationic antistatic agents may generally include, but not be limited to, quaternary ammonium salts and imidazolines that possess a positive charge. Examples of nonionics include the poly(oxyalkylene) derivatives, e.g., ethoxylated fatty acids like EMEREST® 2650 (an ethoxylated fatty acid, available from Henkel Corporation, Mauldin, S.C.), ethoxylated fatty alcohols like TRYCOL® 5964 (an ethoxylated lauryl alcohol, available from Henkel Corporation, Mauldin, S.C.), ethoxylated fatty amines like TRYMEEN® 6606 (an ethoxylated tallow amine, available from Henkel Corporation, Mauldin, S.C.), alkanolamides like EMID® 6545 (an oleic diethanolamine, available from Henkel Corporation, Mauldin, S.C.), and any combination thereof. Anionic and cationic materials tend to be more effective antistatic agents.

It should be noted that while porous mass sections and filter sections discussed herein are primarily for smoke filters, they may be used as fluid filters (or parts thereof) in other applications including, but not limited to, liquid filtration, water purification, air filters in motorized vehicles, air filters in medical devices, air filters for household use, and the like. One skilled in the arts, with the benefit of this disclosure, should understand the necessary modification and/or limitations to adapt this disclosure for other filtration applications, e.g., size, shape, size ratio of active and binder particles, and composition of the porous mass sections and filter sections. By way of nonlimiting example, the porous mass sections and filter sections may be formed into other shapes like hollow cylinders for a concentric water filter configuration or pleated sheets for an air filter.

Embodiments disclosed herein include:

A: a filter that includes a porous mass section comprising a plurality of active particles, a plurality of binder particles, and an active coating disposed on at least a portion of the active particles and the binder particles, wherein the active particles and the binder particles are bound together at a plurality of contact points; and a filter section;

B: a filter that includes a porous mass section comprising a plurality of active particles and a plurality of binder particles, wherein the active particles and the binder particles are bound together at a plurality of contact points without an adhesive; and a filter section comprising an active dopant; and C: a porous mass that includes a plurality of active particles and a plurality of binder particles, wherein the active particles and the binder particles are bound together at a plurality of contact points, wherein the active particles comprise at least one selected from the group consisting of iodine pentoxide, phosphorous pentoxide, manganese oxide, copper oxide, iron oxide, molecular sieves, aluminum oxide, gold, platinum, cellulose acetate, and any combination thereof.

Each of embodiments A, B, and C may have one or more of the following additional elements in any combination: Element 1: the active particles comprising at least one selected from the group consisting of iodine pentoxide, phosphorous pentoxide, manganese oxide, copper oxide, iron oxide, molecular sieves, aluminum oxide, gold, platinum, cellulose acetate, and any combination thereof; Element 2: the active particles comprising iodine pentoxide and the active coating (or the active dopant) comprising triacetin; Element 3: the active coating (or the active dopant) comprising at least one selected from the group consisting of triacetin, malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate, carboxylated acrylate, liquid amines, vitamin E, triethyl citrate, acetyl triethyl citrate, tributyl citrate acetyl tributyl citrate, acetyl tri-2-ethylhexyl, a non-ionic surfactant, polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, and any combination thereof; Element 4: the active coating (or the active dopant) comprising is present in an amount of about 3% to about 15%; Element 5: the filter section comprising (or further comprising) at least one selected from the group consisting of a plurality of second active particles, an active dopant, and any combination thereof (unless otherwise provided for); Element 6: the filter (and/or porous mass) has an encapsulated pressure drop of about 0.1 mm of water per mm of length to about 20 mm of water per mm of length; and Element 7: the filter section comprising (or further comprising) at least one selected from the group consisting of cellulose, a cellulosic derivative, a cellulose ester tow, a cellulose acetate tow, a cellulose acetate tow with less than about 10 denier per filament, a cellulose acetate tow with about 10 denier per filament or greater, a random oriented acetate, a paper, a corrugated paper, polypropylene, polyethylene, a polyolefin tow, a polypropylene tow, polyethylene terephthalate, polybutylene terephthalate, a coarse powder, a carbon particle, a carbon fiber, a fiber, a glass bead, a zeolite, a molecular sieve, and any combination thereof.

By way of non-limiting example, exemplary combinations independently applicable to A, B, and C include: Element 1 in combination with Element 3; Elements 1, 3, and 4 in combination; Elements 1, 3, and 6 in combination; Element 2 in combination with Element 6; and so on.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A porous mass comprising:

a plurality of active particles, a plurality of binder particles, and an active coating disposed on at least a portion of the active particles and the binder particles, wherein the active particles and the binder particles are bound together at a plurality of contact points, and wherein the plurality of active particles comprise iodine pentoxide and the active coating comprises triacetin.

2. A filter comprising the porous mass of claim 1 and a filter section.

3. The filter of claim 2, wherein the filter section comprises at least one selected from the group consisting of a plurality of second active particles, an active dopant, and any combination thereof.

4. The filter of claim 3, wherein the active dopant comprises at least one selected from the group consisting of triacetin, malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate, carboxylated acrylate, liquid amines, vitamin E, triethyl citrate, acetyl triethyl citrate, tributyl citrate acetyl tributyl citrate, acetyl tri-2-ethylhexyl, a non-ionic surfactant, polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, and any combination thereof.

5. The filter of claim 3, wherein the active dopant is present in an amount of about 3% to about 15%.

6. The filter of claim 2, wherein the filter has an encapsulated pressure drop of about 0.1 mm of water per mm of length to about 20 mm of water per mm of length.

7. A smoking device comprising a filter of claim 2 in fluid communication with a smokable substance.

8. A filter comprising:

a porous mass section comprising a plurality of active particles and a plurality of binder particles, wherein the active particles and the binder particles are bound together at a plurality of contact points without an adhesive, and wherein the plurality of active particles comprise iodine pentoxide; and a filter section comprising an active dopant comprising triacetin.

9. The filter of claim 8, wherein the active dopant further comprises at least one selected from the group consisting of malic acid, potassium carbonate, citric acid, tartaric acid, lactic acid, ascorbic acid, polyethyleneimine, cyclodextrin, sodium hydroxide, sulphamic acid, sodium sulphamate, polyvinyl acetate, carboxylated acrylate, liquid amines, vitamin E, triethyl citrate, acetyl triethyl citrate, tributyl citrate acetyl tributyl citrate, acetyl tri-2-ethylhexyl, a non-ionic surfactant, polyoxyethylene (POE) compounds, POE (4) lauryl ether, POE 20 sorbitan monolaurate, POE (4) sorbitan monolaurate, POE (6) sorbitol, POE (20) $C_{16}$, $C_{10}$-$C_{13}$ phosphates, and any combination thereof.

10. The filter of claim 8, wherein the filter has an encapsulated pressure drop of about 0.1 mm of water per mm of length to about 20 mm of water per mm of length.

11. A smoking device comprising the filter of claim 8 in fluid communication with a smokable substance.

* * * * *